US005539373A

United States Patent [19]

Pfaffenberger et al.

[11] Patent Number: 5,539,373

[45] Date of Patent: Jul. 23, 1996

[54] ROTOR STRUCTURE FOR A POSITION SENSOR

[75] Inventors: David S. Pfaffenberger, Mishawaka; Cameron B. Erekson, Elkhart, both of Ind.; Donald G. Witzel, Fairport, N.Y.

[73] Assignees: CTS Corporation, Elkhart, Ind.; General Motors Corporation, Detroit, Mich.

[21] Appl. No.: 148,485

[22] Filed: Nov. 8, 1993

[51] Int. Cl.[6] ..... H01C 10/00

[52] U.S. Cl. ..... 338/196; 338/166; 338/185; 73/118.1

[58] Field of Search ..... 338/118, 138, 338/160, 162, 166, 175, 174, 184, 185, 196, 197, 199; 73/118.1

[56] References Cited

U.S. PATENT DOCUMENTS

| | | | |
|---|---|---|---|
| 4,430,634 | 2/1984 | Hufford et al. | 338/164 |
| 4,616,504 | 10/1986 | Overcash et al. | 338/184 |
| 4,621,250 | 11/1986 | Echasseriau et al. | 338/162 |
| 4,649,367 | 3/1987 | Biermann et al. | 338/184 |
| 4,672,356 | 6/1987 | Biermann et al. | 338/184 |
| 4,688,420 | 8/1987 | Minagawa | 73/118.1 |
| 4,693,111 | 9/1987 | Arnold et al. | 338/120 |
| 4,703,649 | 11/1987 | Eitoku et al. | 338/199 |
| 4,715,220 | 12/1987 | Eitoka et al. | 338/199 |
| 4,718,272 | 1/1988 | Plapp | 73/118.1 |
| 4,719,795 | 1/1988 | Eitoka et al. | 338/171 |
| 4,743,882 | 5/1988 | Simon | 338/184 |
| 4,812,803 | 3/1989 | Hochholzer | 338/175 |
| 4,827,884 | 5/1989 | Cook | 123/336 |
| 4,866,981 | 9/1989 | Matsumoto et al. | 73/118.1 |
| 4,908,598 | 3/1990 | Burger et al. | 338/174 |
| 4,933,661 | 6/1990 | Oda et al. | 338/174 |
| 5,070,728 | 12/1991 | Kubota et al. | 338/184 |
| 5,133,321 | 7/1992 | Hering et al. | 123/399 |
| 5,150,095 | 9/1992 | Jones | 338/196 |
| 5,300,918 | 4/1994 | Becker | 338/196 |
| B1 4,355,293 | 9/1985 | Driscoll | 338/184 |

FOREIGN PATENT DOCUMENTS 58-70104 4/1983 Japan .

*Primary Examiner*—Tu Huang
*Attorney, Agent, or Firm*—Albert W. Watkins

[57] ABSTRACT

A rotor for use in a rotary position sensor includes an opening designed to receive a shaft having a flat. The rotor has a wedge within the opening designed to engage the shaft firmly but minimize insertion forces. Several troughs running parallel to the shaft and adjacent to the wedge aid in retention by adding a controlled amount of resilience to the rotor. On a shaft receiving end of the rotor there is an additional taper to help with coaxial alignment of the rotor opening and the shaft. On the shaft exiting end there is a half-moon like configuration designed to provide a force opposing surface during shaft insertion while not adversely impacting either the full insertion of the shaft or potential drag between the rotor and the sensor housing. The rotor is designed to offer unique advantage in insertion force to install the rotor on the shaft, while retention force and potential drag against the position sensor housing are minimized.

8 Claims, 4 Drawing Sheets

ROTOR STRUCTURE FOR A POSITION SENSOR

CROSS REFERENCE TO RELATED APPLICATIONS

This application contains subject matter related to the pending application entitled "Bearing Free, Spring Free Throttle Position Sensor," by Davis S. Pfaffenberger Ser. No. 08/082,140 filed Jun. 23, 1993.

BACKGROUND OF THE INVENTION

1. Field of the Invention

This invention pertains to rotary variable resistor position sensors generally, and specifically to rotor configurations used therein.

2. Description of the Related Art

Many internal combustion engines use a throttle valve to control the amount of air entering the engine. The throttle valve is also commonly called a butterfly or throttle flap. Throttle valves are used in gasoline, diesel and other alternatively fueled vehicles. The throttle valve may be opened to provide unimpeded air intake through a throttle body. Alternatively, the throttle valve may be closed to greatly restrict the passage of air. By controlling the amount of air that reaches the combustion chamber, the throttle valve forms part of the primary engine speed control. The throttle valve may be mechanically linked to the accelerator pedal or, in some instances, linked through a combination of electrical and mechanical interconnections.

There are many efforts to improve the efficiency of internal combustion engines and similarly to reduce the emissions, or pollutants, that are produced by these engines. A vital part of better efficiency and reduced emissions is the electronic control circuitry used with the engines. The electronic circuitry monitors various engine parameters and provides feedback or controls to the engine. The feedback may be a signal which in some way improves efficiency or reduces emissions. The signal may, for example, be used to control the amount of fuel injected into the engine or the timing of ignition sparks.

A potentiometer is often used to sense the position of the throttle valve. This potentiometer is in some ways similar to the volume controls used in radio and television receivers. A voltage is applied across two extreme ends of a resistor. An intermediate tap is provided between the two extremes of the resistor. The tap is mechanically linked to the device which is to be sensed, and the position of the device is determined by the voltage at the intermediate tap.

Examples of conventional throttle position sensors include U.S. Pat. No. 4,430,634 by Hufford et al and assigned to the present assignee and also U.S. Pat. Nos. 4,355,293 by Driscoll and 5,133,321 by Hering et al, incorporated herein by reference. Other examples may be found in U.S. Pat. Nos. 4,616,504, 4,621,250, 4,688,420, 4,703,649, 4,715,220, 4,719,795, 4,743,882, 4,812,803, 4,933,661, 5,133,321, and Japanese Kokai 58-70104, also incorporated herein by reference.

In the prior art, a lever such as shown in U.S. Pat. Nos. 4,355,293 and 4,430,634 or special drives such as shown in U.S. Pat. No. 4,616,504 were used. These drives ensure that the throttle sensor will allow the throttle valve to return to an idle position. Engagement between the sensor and the throttle shaft has then necessitated the use of a return spring so that as the throttle shaft returns to idle position, the throttle position sensor also returns and tracks the position of the throttle valve.

Other prior art sensors incorporate the sensor directly into the throttle body. Exemplary are U.S. Pat. Nos. 4,649,367, 4,672,356, 4,693,111, 4,718,272, 4,827,884, 4,866,981 and 5,070,728 incorporated herein by reference. These concepts offer advantage in simplicity. However, there is little control over the element contactor interface, which has been determined to be very important for the life of the unit.

Variations in contact pressure, contact orientation, lube and other similar factors all impact the performance of the device. Further, field replacement is important for service repair, and the service replacement should be of the same quality as the original device. These throttle body incorporated sensors do not have the precise control over lube thickness and composition, protection of vital components while shelved awaiting installation, and control over contactor and element relationships that are desirable features.

The shape of the contactor structure is, for obvious reasons, critical to the performance of the device. Where contactor rakes are used, a bent rake may reduce the life of the device to less than one hundredth the normal life. Yet, in those devices that mount into the throttle body wall, the contactor will be exposed during shipment of service parts and will be handled to an undesirable degree during installation.

With electronics becoming more prevalent, the ability to sense various engine functions and also in some instances non-engine or indirect engine functions is more desirable. The present invention seeks to overcome the limitations of the prior art sensors and offers a rotor structure for a position sensor that delivers advanced features without compromise. The inventive features are applicable to position sensors in throttle and accelerator pedal position sensing, machine and industrial robot position sensing, and other applications for potentiometric and other sensor devices that may be mounted to a rotary shaft. The rotor structure is specifically optimized for performance together with a resistive position sensor.

SUMMARY OF THE INVENTION

A rotor for use in a rotary sensor includes an opening designed to receive a shaft having a flat. The rotor has a wedge within the opening designed to engage the shaft and thereby provide a relatively low insertion force while assuring a firm, stable connection between the rotor and shaft. Several troughs running parallel to the shaft and adjacent to the wedge aid in retention by adding a controlled amount of resilience to the rotor. On a shaft receiving end of the rotor there is an additional taper to help with coaxial alignment of the rotor opening and the shaft. On the shaft exiting end there is a half-moon like configuration designed to provide a force opposing surface during shaft insertion while not adversely impacting either the full insertion of the shaft or potential drag between the rotor and the sensor housing. The rotor is designed to offer unique advantage in reduced insertion force to install the rotor on the shaft, while assuring a stable connection between the rotor and shaft and minimizing potential drag against the position sensor housing.

DESCRIPTION OF THE PREFERRED EMBODIMENT

Figure 1:
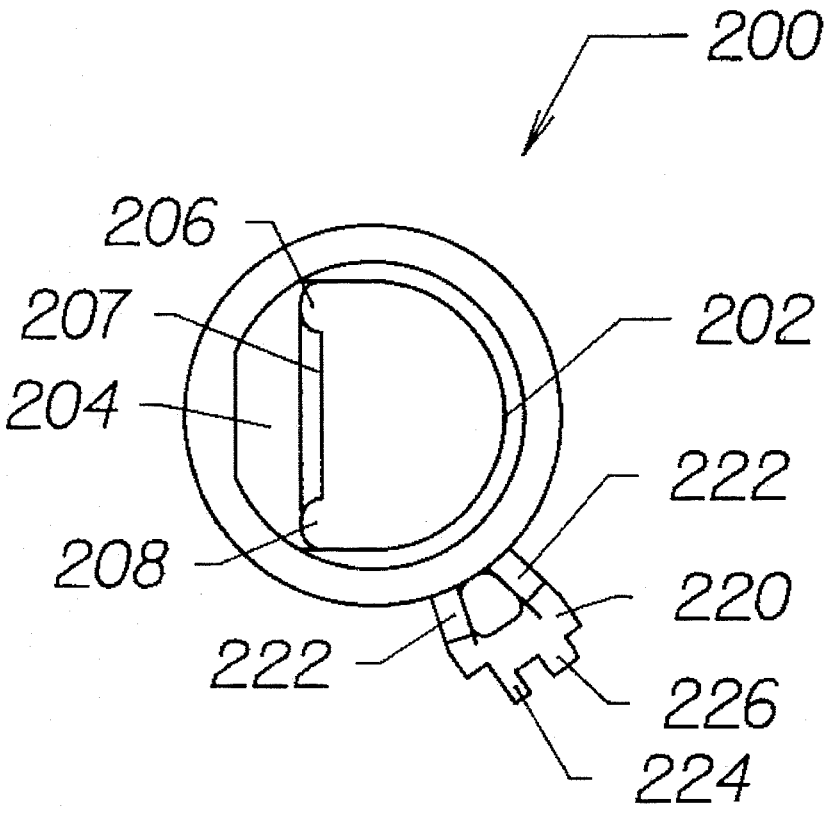
FIGS. 1–4 illustrate the rotor without contactor from a bottom, side, top and cross-section view, respectively.
Figure 2:
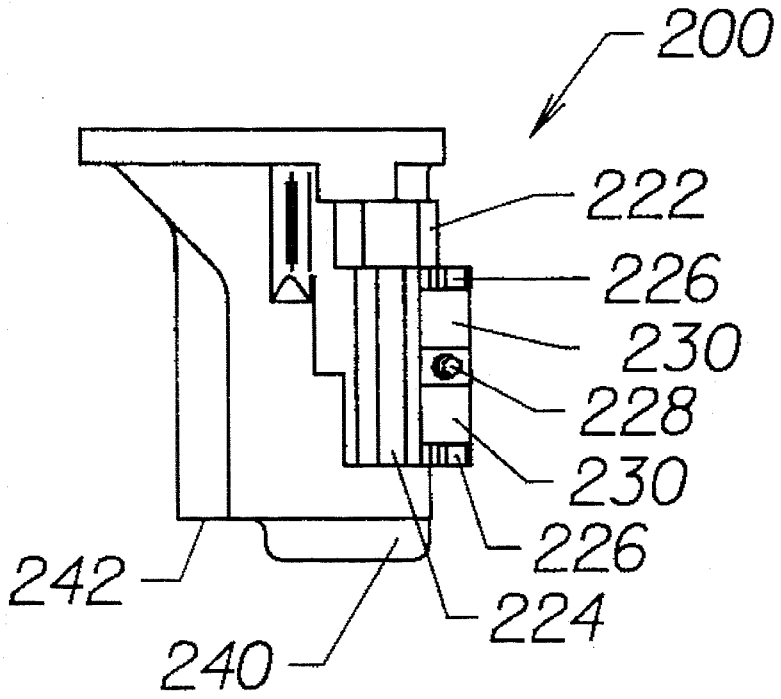
Figure 3:
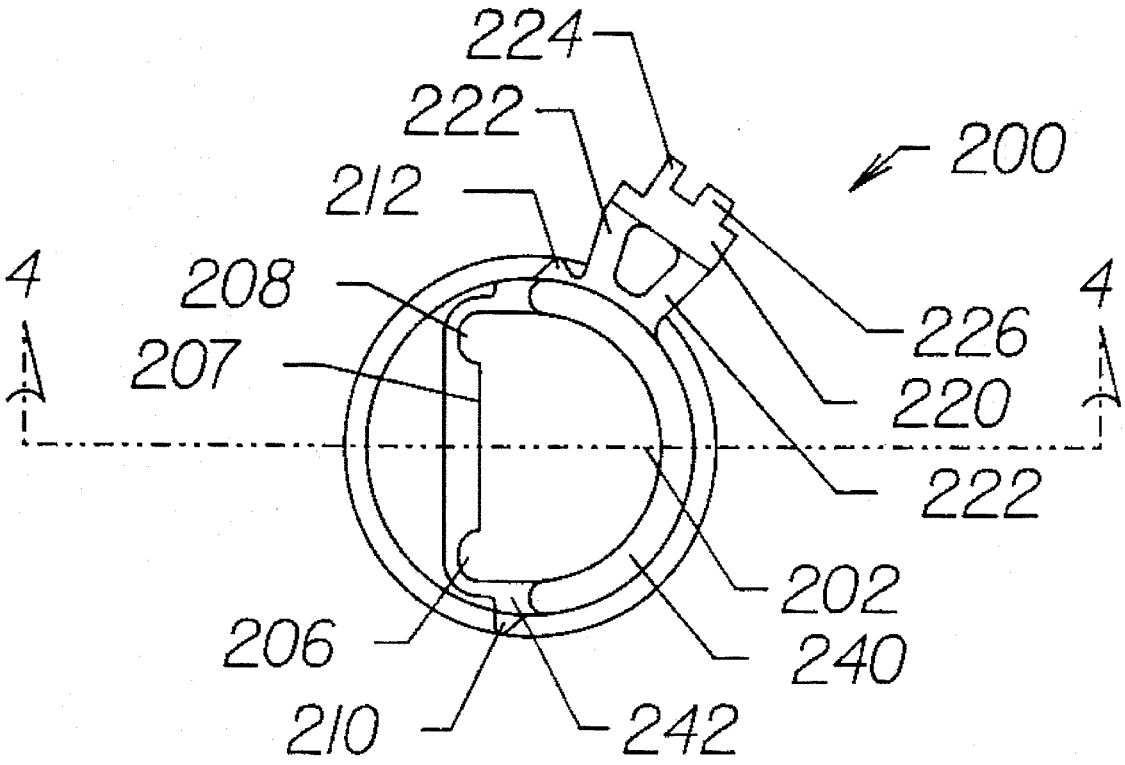
Figure 4:
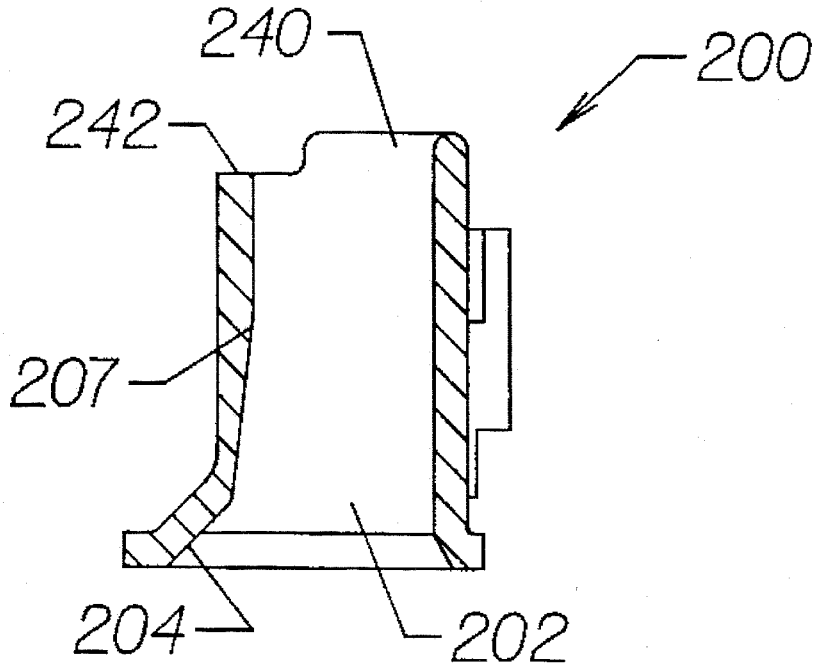

FIGS. 1–4 illustrate rotor 200, which is a preferred embodiment of the invention. These illustrations are provided as an example of the invention, but are in no way intended to limit the scope of the invention. Many design features and applications for the invention will occur to one of ordinary skill in the art after a review of these illustrations. Similar numbering has been used across all drawing figures where like components are shown, to simplify description and review of the preferred embodiment. Further, where a sensor is described, one suitable example of such a sensor is disclosed in the pending Pfaffenberger application, which best utilizes all of the benefits and advantages of the present invention.

Rotor structure 200 is illustrated in FIGS. 1–4. Rotor structure 200 includes a shaft opening 202. At a first end of opening 202 is a tapered surface 204 which serves to facilitate alignment of a shaft to be sensed (not shown) with rotor structure 200. At an end of opening 202 opposite tapered surface 204 is a slight extension 240. Extension 240 provides a bearing surface of less than full circle through which force may be applied to force rotor structure 200 onto the shaft. Extension 240 extends beyond end 242 of opening 202 so that if there is undesired drag between rotor structure 200 and fixed parts of the sensor, that this be minimized.

Extending axially with opening 202 are two long grooves 206 and 208, and a compression wedge 207. Compression wedge 207 engages a flat upon the throttle shaft to ensure exact alignment between the rotor structure and the throttle shaft. Compression wedge 207 restricts opening 202 to a size just smaller than the shaft size, forcing rotor structure 202 to flex slightly to allow the throttle shaft to pass through. Grooves 206 and 208 provide controlled lines and amounts of flexure while ensuring that compression wedge 207 is retained tightly against the flat of the throttle shaft.

Extending on an exterior circumference of rotor structure 200 are two arms 222 which join to form a contactor support block 220. Contactor support block 220 includes contactor support surfaces 230 for supporting a contactor such as contactor 300, with contactor alignment edge 224 and alignment stubs 226. In production, contactor 300 is set against surfaces 230 and is heat staked in place by thermally deforming small heat stake protrusion 228, edge 224 and stubs 226. This structure serves to support contactor 300 and ensures tracking between contactor 300 and the throttle shaft.

The installation of a position sensor embodying rotor 200 will involve pressing the sensor towards a shaft. The shaft should pass through shaft opening 202, but in order to do so, rotor structure 200 must be forced around the shaft. This force may be applied by directly or indirectly pressing against extension 240. By not closing the end of shaft opening 202, no undesirable spring forces are created. In the prior art where the end is closed, the end during insertion forms a domed surface, thereby spring loading the rotor more tightly against the shaft. While in some instances this could be desired, minimal control over these forces may result in inaccurate insertion of rotor 200 upon the shaft.

Figure 5:
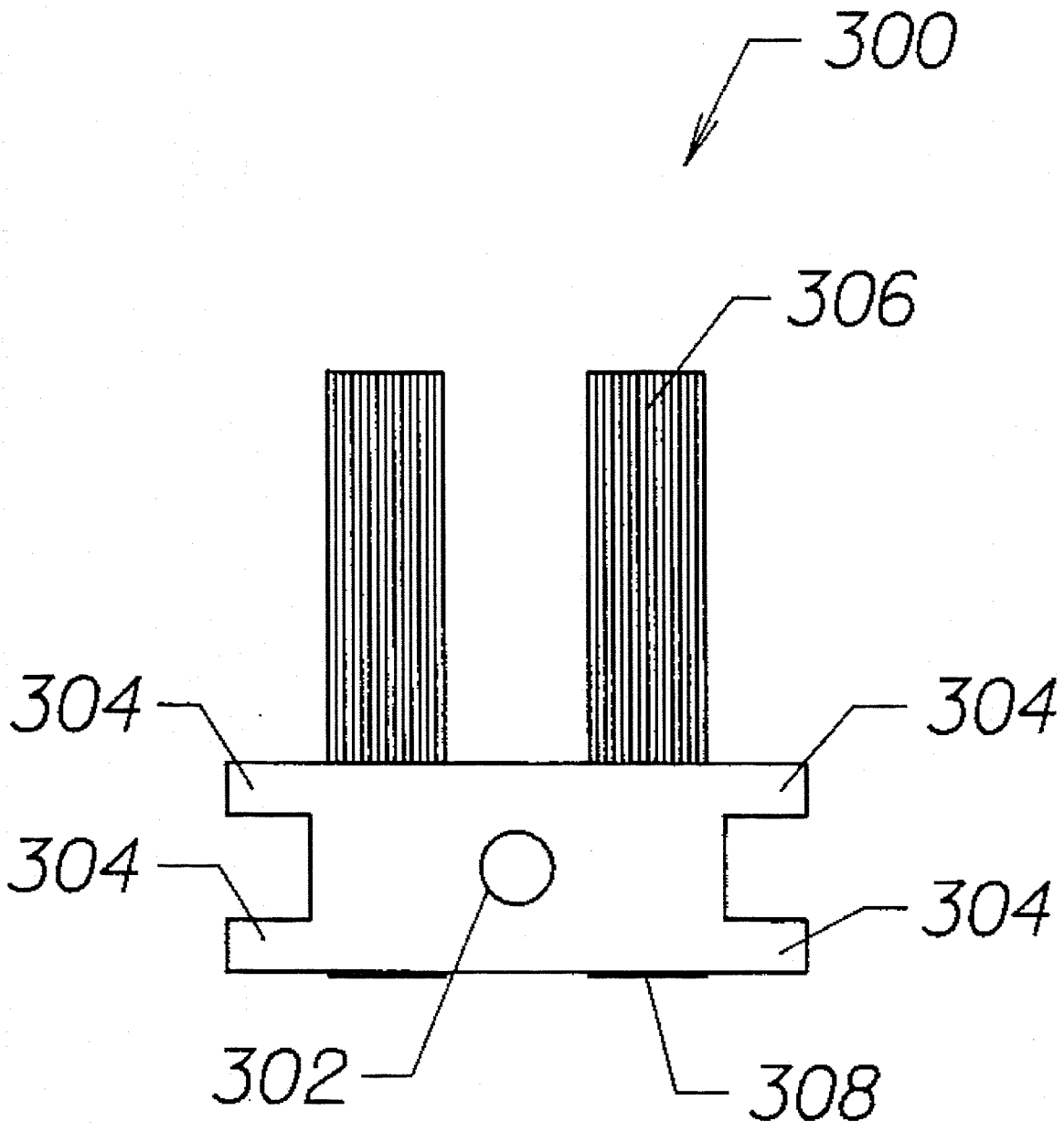
FIG. 5 illustrates a contactor structure suited for use with the rotor of FIGS. 1–4.
Figure 6:
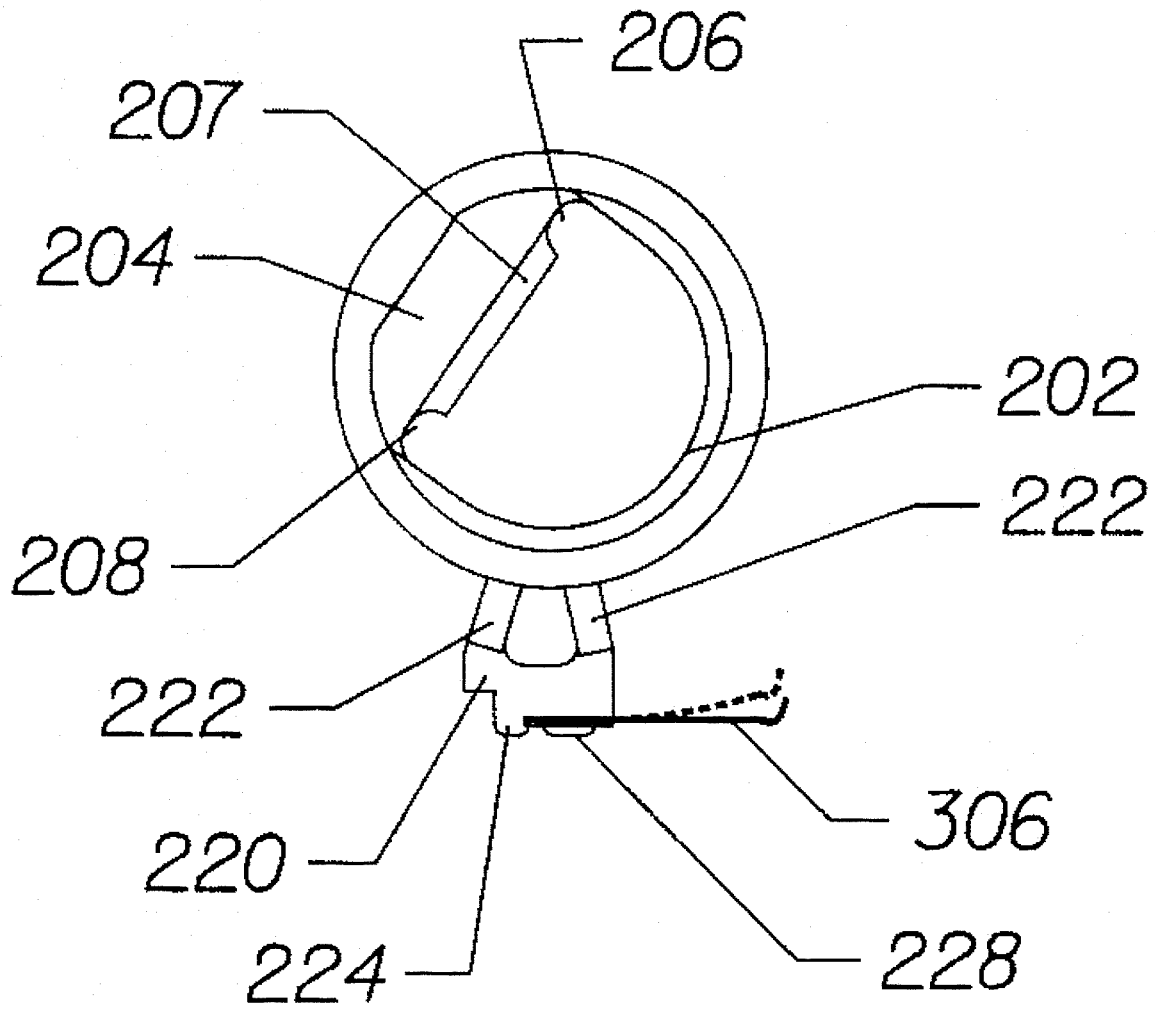
FIG. 6 illustrates the rotor and contactor in assembled configuration.

FIG. 5 illustrates contactor 300 in further detail and FIG. 6 illustrates rotor structure 200 interconnected to contactor 300. Contactor 300 is shown with brushes 306 protruding away from opposite edge 308, although it will be immediately apparent to those skilled in the art that brushes are but one of many choices available for contactor structures. Other configurations include paddles, spoons, rakes, multi-fingered contacts, blades, and others. There are four small tabs 304 that engage with and partially surround on three sides alignment stubs 226. The center of contactor 300 has a small hole 302 through which fits heat stake protrusion 228. In assembly, edge 308 of contactor 300 is abutted with alignment edge 224. Hole 302 is aligned with heat stake protrusion 228, while alignment stubs 226 are centered between tabs 304. The contactor 300 is then pressed down against surfaces 230 and heat stake protrusion 228, edge 224 and stubs 226 are formed down to retain contactor 300 in place against surfaces 230.

On a periphery of rotor 200 are two small protrusions 210 and 212. These protrusions 210 and 212 do not form an essential part of the present invention, but are more fully described in the pending Pfaffenberger application.

While the foregoing details what is felt to be the preferred embodiment of the invention, no material limitations to the scope of the claimed invention is intended. For example, the disclosure illustrates a rotor structure having unique benefit to rotary variable resistor sensors that utilize a contactor affixed to the rotor. However, from the teachings herein, one of ordinary skill would be able to apply the invention to non-resistive rotary sensor structures and still obtain many of the benefits and advantages. Further, features and design alternatives that would be obvious to one of ordinary skill in the art are considered to be incorporated herein.

We claim:

1. A rotor for use in a rotary position sensor and designed to receive a shaft therein, said rotor comprising:

a body;

a passage extending from a first end of said rotor entirely through said body to a second end of said rotor along an axis, said passage designed to receive said shaft therein, said passage open at both ends and throughout;

means for engaging said shaft and rotating said rotor therewith; and an extension protruding from said body in a direction parallel to and generally about said axis, said extension partially but not completely surrounding said passage.

2. The rotor of claim 1 wherein said passage comprises a generally cylindrical opening in said body, said cylindrical opening coaxial with said axis.

3. The rotor of claim 2 wherein said engaging means comprises a relatively flat surface deformation in said generally cylindrical opening, said flat surface closer to said axis than a cylindrical surface of said generally cylindrical opening.

4. The rotor of claim 3 wherein said engaging means further comprises a slight deviation from parallel with said axis, said flat surface most distant from said axis at said first end of said rotor and said flat surface least distant from said axis between said first end of said rotor and said second end of said rotor.

5. The rotor of claim 4 further comprising a first small trough extending into said body away from said axis but generally parallel to said axis.

6. The rotor of claim 5 further comprising a second small trough similar to said first small trough.

7. The rotor of claim 6 wherein said first and said second small troughs are adjacent to and separated by said flat surface.

8. The rotor of claim 1 further comprising a contactor fixedly attached to said rotor.

* * * * *